US005199936A

United States Patent [19]

Moye

[11] Patent Number: 5,199,936

[45] Date of Patent: Apr. 6, 1993

[54] PLYOMETRIC TRAINING DEVICE

[75] Inventor: Charles W. Moye, Akron, Ohio

[73] Assignee: All Ohio Youth Athletic Club, Akron, Ohio

[21] Appl. No.: 567,928

[22] Filed: Aug. 15, 1990

[51] Int. Cl.[5] ..... A63B 21/02

[52] U.S. Cl. ..... 482/148; 482/126

[58] Field of Search ..... 272/93, 119, 142, 139; 482/126, 136, 148, 10, 45, 121, 122, 127

[56] References Cited

U.S. PATENT DOCUMENTS

| | | | |
|---|---|---|---|
| 385,901 | 7/1888 | Barnett | 482/126 |
| 2,526,347 | 11/1950 | Mohler et al. | 482/126 |
| 3,442,513 | 5/1969 | Fisher | 272/93 |
| 4,169,590 | 10/1979 | Johansen | 272/142 |
| 4,645,197 | 2/1987 | McFee | 272/142 |
| 4,793,609 | 12/1988 | Coutts et al. | 482/126 |

FOREIGN PATENT DOCUMENTS

| | | | |
|---|---|---|---|
| 0705803 | 5/1941 | Fed. Rep. of Germany | 272/93 |

*Primary Examiner*—Stephen R. Crow

*Attorney, Agent, or Firm*—Renner, Kenner, Greive, Bobak, Taylor & Weber

[57] ABSTRACT

Athletic training apparatus (10) for conducting conditioning drills or exercises includes a generally U-shaped frame (11) having a cross beam (15) and a pair of extending arms (25, 35) spaced and joined by the cross beam, an impact member (50) of elastomeric material suspended between the arms, and means (37) for selectively adjustably tensioning the impact member. A harness (70) may be employed for assisting an athlete to hold the frame in operative position for conducting the drills or exercises.

19 Claims, 3 Drawing Sheets

PLYOMETRIC TRAINING DEVICE

TECHNICAL FIELD

Generally, the present invention relates to a training apparatus for athletics. More particularly, the present invention relates to training apparatus which is employed for plyometric drills and exercises for athletes. More specifically, the invention relates to plyometric training apparatus which assists athletes in the execution of drills and exercises designed to increase running speed or otherwise develop an explosive physical reaction by particular muscle groups.

BACKGROUND ART

In virtually all types of sporting endeavors for many years, conditioning played a relatively insignificant role in preparing athletes for various types of sporting events. The basic belief during these years was that countless repetitions of the exact motions performed in a sport or athletic event constituted the only effective way in which an athlete's performance could be improved. In some instances, an extent of conditioning was used to supplement actual participation in the mechanics of the sport. This conditioning normally took the form of calisthenics to maintain or enhance flexibility and an extent of running to enable an athlete to control fatigue. Later, it slowly became appreciated that speed, quickness, and acceleration are significant ingredients of nearly every type of athletic endeavor. It further became appreciated that these explosive reaction characteristics constituted a form of power. In mathematical terms, power equals force times velocity, which transfers to the strength of an athlete and the velocity, or speed, at which the strength is applied to execute a motion or combination of motions.

Armed with this extent of understanding, a degree of strength conditioning was introduced into the training facets of a number of sports. Strength conditioning was essentially a known activity which could be implemented primarily through the use of weights. This technology was employed to increase the strength or force component of athletic power with results which eventually became widely accepted and employed in virtually all sports.

The velocity, or speed, component of developing the power for running speed, quickness, and other explosive reactions remained largely neglected. It was a widely accepted belief that speed and quickness were an innate quality which athletes either possessed or did not possess. It was, therefore, presumed that nothing significant could be done to improve speed and quickness characteristics in a particular athlete. Only in very recent years has there been widespread knowledge that this premise was fallacious.

Technical analysis and testing which has taken place in recent years has demonstrated the possibility of improving an athlete's velocity, or speed, characteristics in the application of his strength. As a result, exercises were developed which tended to decrease the time between the eccentric, or lengthening, contraction of sports-active muscles and the concentric, or shortening, contraction of the muscles. This resulted in adoption of jumping, leaping, and bounding exercises which stressed decreasing the time between these muscular responses. For these purposes, training equipment, if any, which was employed normally involved boxes or platforms raised different distances off the ground, which assisted athletes in effecting these muscular responses. In other instances, a form of resistance, such as elastomeric cords, have been employed to provide an extent of resistance to the conduct of these exercises.

Another facet of the velocity, or speed, component of power which was slow to be recognized was that the central nervous system is significant in providing signals to the muscles, controlling their rate of actuation. In this respect, interest was focused on overspeed training for athletic movements, which endeavored to train athletes under conditions where running stride or other motion are compelled at overspeed, or a speed greater than the athlete's normal maximum, to effectively train the central nervous system to accept and institute a faster rate of actuation. Overspeed activities have been somewhat limited to areas such as running events in track and field, where by virtue of another runner or an elastic band or cable, a runner is forced to exceed the normal stride rate for a limited time period.

There has not, however, been any significant introduction of training equipment which is dedicated to activities which have become known as plyometric training. In particular, there have been few devices which endeavor to accomplish a decrease in the time between muscle concentric contraction and eccentric contraction and overspeed training to concurrently condition the central nervous system.

DISCLOSURE OF THE INVENTION

Therefore, an object of the present invention is to provide athletic training apparatus specifically designed for carrying out plyometric conditioning drills and exercises. Another object of the present invention is to provide such training apparatus which can be employed in a great number of types of drills designed to condition different muscle groups which are employed in specific sports or specific facets of a sport. A further object of the invention is to provide such training apparatus which can be employed for form analysis and correction of incremental elements of various sports activities and movements. Yet another object of the present invention is to provide such training apparatus which has direct application in virtually all types of sports activities requiring explosive reaction and quickness characteristics.

Another object of the present invention is to provide athletic training apparatus which inherently provides a key ingredient of plyometric exercises, namely, overspeed pace training, to develop the desired explosive reaction. A further object of the invention is to provide such training apparatus which not only permits but provides a positive assist to overspeed pace training exercises. Another object of the present invention is to provide such training apparatus which provides overspeed pace training without danger of possible loss of control by the athlete, which is inherent in various other methods of overspeed training. Another object of the invention is to provide such training apparatus in which the athlete remains fully in control of the speed and intensity of the exercises performed. Yet another object of the invention is to provide such training apparatus which can supplant substantial amounts of training often carried out on cement or other undesirable surfaces, thus reducing the possibility of athletes developing shin splints, stress fractures, and other injuries commonly associated with strenuous exercises on such surfaces.

Another object of the present invention is to provide training apparatus which has a wide range of potential for utilization in various types of plyometric conditioning drills and exercises. Another object of the invention is to provide such training apparatus which can be used indoors or in other confined areas, as well as outdoors, for year-round training in all geographic locations. Still another object of the invention is to provide such training apparatus which is adjustable to a wide range of athletes in terms of size and strength and which readily adjusts to challenge improved performance on the part of the athlete. Another object of the invention is to provide such training apparatus which is capable of being used by an athlete individually, as well as in team training applications where a second athlete assists in holding or positioning the training apparatus while a drill or exercise is carried out by an athlete.

Another object of the present invention is to provide plyometric training apparatus which is of rugged construction and is not readily susceptible to damage absent gross misuse. Yet another object of the invention is to provide such training apparatus which can be permanently mounted or is capable of being used as a portable device. Still a further object of the present invention is to provide such training apparatus which is relatively compact in its operative form and which is capable of folding into a small package for storage or transport purposes. Yet a further object of the present invention is to provide such training apparatus which is relatively inexpensive and in which damaged or lost parts can be readily replaced.

In general, athletic training apparatus according to the invention for conducting conditioning drills or exercises includes a generally U-shaped frame having a cross beam and a pair of extending arms spaced and joined by the cross beam, an impact member of elastomeric material suspended between the arms, and means for selectively adjustably tensioning the impact means. A harness may be employed for assisting the athlete to hold the frame in operative position for conducting the drills or exercises.

PREFERRED EMBODIMENT FOR CARRYING OUT THE INVENTION

Figures 1, 2, 3:
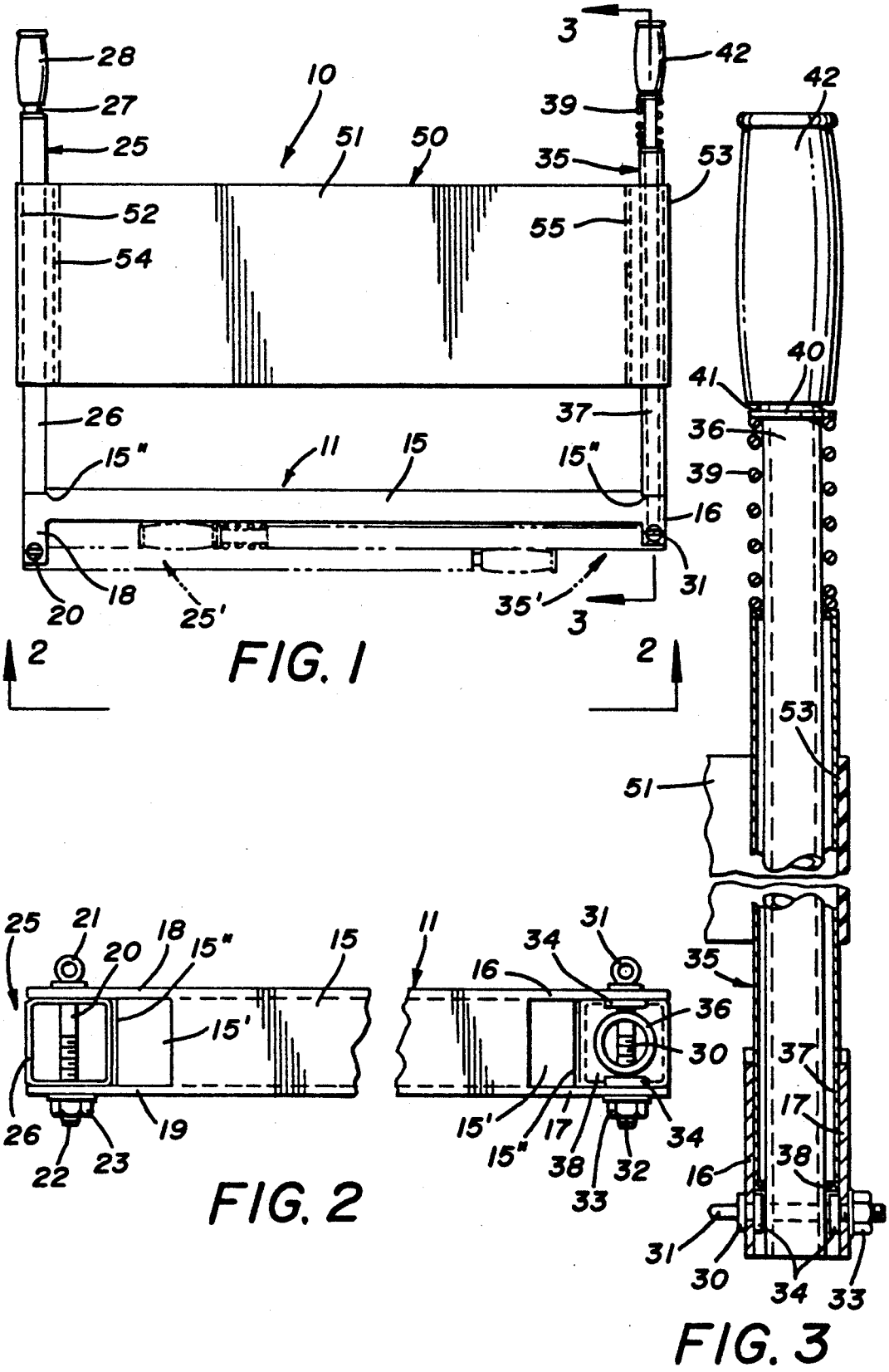
FIG. 1 is a top plan view of a plyometric training device incorporating the concepts of the present invention showing the device in the operative position in solid lines and in the collapsed, transport position in chain lines.
FIG. 2 is an enlarged fragmentary elevational view of the plyometric training device of FIG. 1 as viewed substantially along the line 2—2 of FIG. 1.
FIG. 3 is an enlarged cross-sectional view of the plyometric training device of FIG. 1 taken substantially along line 3—3 of FIG. 1 showing the details of the rotational locking device for tensioning the elastomeric contact member.
Figure 6:
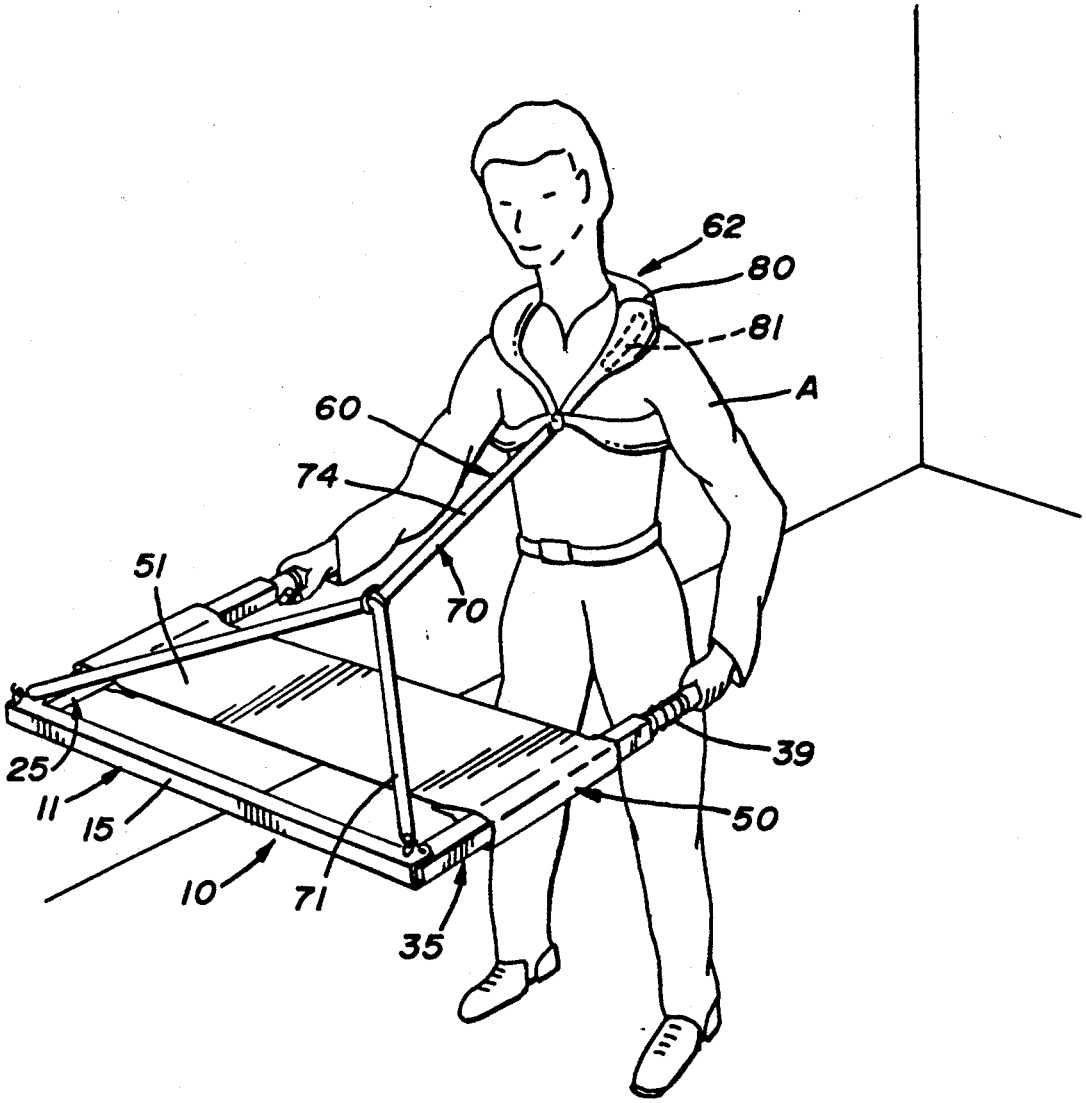
FIG. 6 is an isometric view of an athlete wearing the chest vest connector which is supporting the plyometric training device in position for executing an exemplary plyometric drill or exercise.

An athletic training device for conducting drills or exercises, as for instance in the nature of plyometric training, is generally indicated by the numeral 10. As seen in FIG. 1 of the drawings, the training device 10 has an overall configuration in the nature of a U-shaped frame, generally indicated by numeral 11. The frame 11 has as a structural component thereof a cross beam 15. As best seen in FIGS. 1, 2, and 6, the cross beam 15 may conveniently be a hollow rectangular member of substantial longitudinal extent. As shown, one longitudinal extremity of the cross beam 15 has an upper flange 16 and a lower flange 17, which lie in substantially parallel planes. The other extremity of the cross beam 15 similarly has an upper flange 18 and a lower flange 19. As best seen in FIG. 1, the flanges 16, 17 and 18, 19 at both extremities of the cross beam 15 extend a distance laterally of the dimensions of cross beam 15 for a purpose to be hereinafter detailed. It is to be noted in this respect that the flanges 18, 19 extend laterally a greater distance than the flanges 16, 17 for reasons which will become apparent in the ensuing discussion.

One longitudinal extremity of the cross beam 15 of frame 11 mounts an arm assembly, generally indicated by the numeral 25. The arm assembly 25 has an elongate support 26, which is preferably of rectangular cross-sectional configuration. The support 26 preferably is dimensioned such that its vertical dimension as seen in FIG. 2 is sized to fit snugly internally between the flanges 18 and 19 of the cross beam 15. The arm assembly 25 is attached to the cross beam 15 as by a bolt 20 which extends through flanges 18 and 19 and the upper and lower walls of elongate support 26. As shown, the bolt 20 is preferably a type of eye bolt having an eye 21 at one extremity thereof and having threads 22 proximate the opposite extremity for receiving a conventional nut 23 for securing bolt 20 in place. It will, thus, be appreciated that the bolt 20 operates as a pivot pin for selectively rotating arm assembly 25 from the solid line operative position depicted in FIG. 1 to the chain line storage position 25', also depicted in FIG. 1, where arm assembly 25 substantially parallels the cross beam 15.

It is to be noted that the cross beam 15 has a wall 15' which terminates to form a stop 15'' at a position such as to preclude rotation of arm assembly 25 in a clockwise direction beyond the operative position depicted in FIG. 1 of the drawings. This stop 15'' effectively locks arm assembly 25 in its operative position, as will become apparent from subsequent description.

The end of elongate support 26 of arm assembly 25 opposite the bolt 20 may be provided with a rigidly affixed shaft 27 mounted axially thereof which is adapted to receive a hand grip 28. The hand grip 28 may advantageously be of an elastomeric material to facilitate gripping by an athlete when operating the athletic training device 10.

The longitudinal extremity of cross beam 15 displaced from arm assembly 25 mounts an adjustable arm assembly, generally indicated by the numeral 35. The adjustable arm assembly 35 has an elongate support 36 which is, in this instance, preferably of a circular cross-sectional configuration. The adjustable arm assembly 35 is attached to the cross beam 15 as by a bolt 30 which extends through flanges 16 and 17 and diametrically through the elongate support 36. As shown, the bolt 30 is preferably a type of eye bolt having a eye 31 at one extremity thereof and having threads 32 at the opposite extremity for receiving a conventional nut 33 for securing bolt 30 in place. It will, thus, be appreciated that the bolt 30 operates as a pivot pin for selectively rotating adjustable arm assembly 35 from the solid line operative position depicted in FIG. 1 to the chain line storage position 35', also depicted in FIG. 1, where adjustable arm assembly 35 substantially parallels the cross beam 15.

It is to be noted that the positioning of bolt 20 and bolt 30 may be readily effected in flanges 18 and 19 and flanges 16 and 17, respectively, such as to permit the arms 25 and 35 to assume the chain line positions 25' and 35' depicted in FIG. 1. With this arrangement, it is to be noted that adjustable arm assembly 35 in the storage position 35' is adjacent to and parallels the cross beam 15. The arm assembly 25 in the storage position 25' is adjacent to the adjustable arm assembly 35 and parallels both arm assembly 35 and cross beam 15. Thus, in the storage position, the cross beam 15 and arm assemblies 25 and 35 of frame 11 become a compact rectangular configuration, which is highly convenient for storage and for transportation, if desired. Rotation of each of arm assemblies 25, 35 through approximately 270° moves them from the storage position to the operative position or vice versa.

The adjustable arm assembly 35 differs from arm assembly 25 in other significant respects. In particular, adjustable arm assembly 35 has an elongate sleeve 37 which encompasses a portion of the longitudinal extent of elongate support 36. The sleeve 37 is sized such that it is capable of axial movement relative to elongate support 36 and free rotational movement thereon. Sleeve 37 is of a rectangular cross-sectional configuration and is sized to fit snugly internally between the flanges 16 and 17 of the cross beam 15. The sleeve 37 is preferably of substantially a square cross-sectional configuration such as to permit its positioning internally between flanges 16 and 17 in any of four rotational positions of the sleeve 37. The elongate support 36 may carry a washer 38 which limits travel of sleeve 37 between flanges 16, 17 to a position short of the bolt 30. As seen, particularly in FIGS. 2 and 3, the bolt 30 may carry spacers 34 positioned to either side of the elongate support 36 internally of the flanges 16, 17. The spacers 34 may thus jointly serve to maintain elongate support 36 centered between the flanges 16 and 17 and to serve as a seat for washer 38, as best seen in FIG. 3 of the drawings. It will be noted that sleeve 37 is restrained against rotation by the flanges 16 and 17 of cross beam 15 when it is in the rotationally locked position depicted in FIG. 3 of the drawings.

The sleeve 37 is biased toward the locked position of FIG. 3 by a compression spring 39. The compression spring 39 is telescoped about the elongate support 36 at the extremity of sleeve 37 opposite the extremity which engages the washer 38. The spring 39 is preferably interposed between the extremity of sleeve 37 and a stop washer 40, which is affixed to the elongate support 36 as by a plurality of spot welds 41. It will thus be appreciated that the sleeve 37 is normally biased to its rotationally locked position depicted in FIG. 3 of the drawings. It will be equally apparent that sleeve 37 may be displaced axially along elongate support 36 a sufficient distance such that sleeve 37 moves out of engagement with flanges 16 and 17 for purposes of rotating it through any desired extent of angular displacement. Proximate any desired rotational position of sleeve 37, the sleeve 37 may be aligned with flanges 16 and 17 of cross beam 15 and moved into engagement therewith. The spring 39 operates to fully insert sleeve 37 between flanges 16 and 17 and maintain it seated therein, as depicted in FIG. 3, during operational use of the training device 10.

It is also to be noted that cross beam 15 has a wall 15' proximate the extremity where bolt 30 is located, which also terminates in a stop 15'' such as to preclude rotation of arm assembly 35 in a counterclockwise direction beyond the operative position depicted in FIG. 1 of the drawings. The stop 15'' effectively locks arm assembly 25 in its operative position, as will become apparent from subsequent description.

The end of elongate support 36 of arm assembly 35 opposite the bolt 30 may be provided with a hand grip 42. The hand grip 42 may advantageously be of elastomeric material to facilitate gripping by an athlete when operating the athletic training device 10 and may otherwise be similar to the aforedescribed hand grip 28.

The U-shaped frame 11, with the arms 25, 35 in the operative position depicted in FIG. 1, is adapted to support an impact member, generally indicated by the numeral 50. As seen in FIGS. 1 and 6, the impact member is suspended between the arm assembly 25 and the adjustable arm assembly 35. As shown, the impact member 50 consists of a generally rectangular flexible elastomeric body portion 51. The elastomeric body 51 is preferably of a compound which provides an extent of elongation but which will not be subject to rupture even when violently engaged by arms, legs, or other portions of an athlete's body. The body portion 51 has loops 52 and 53 formed at the longitudinal extremities thereof. The loops 52, 53 can be readily formed by doubling back the extremities of body portion 51 and applying stitches 54 and 55 the full lateral extent of the body portion 51. The body portion 51 is of such a longitudinal extent such that impact member 50 may be readily installed on and removed from arm assemblies 25, 35 by sliding the loops over the hand grips 28 and 42. To this end, the body portion 51 should be of such a longitudinal extent that it is unstressed or preferably provided with an extent of slack for ease of installing and removing impact member 50.

The body portion 51 of impact member 50 is preferably of a lateral extent sufficient to provide a substantial contact surface for body parts of an athlete. A lateral width on the order of 8 to 15 inches has been found satisfactory to accomplish this purpose. It is normally advantageous that the arm assemblies 25, 35 be of a longitudinal dimension significantly greater than the lateral dimension of impact member 50. This permits impact member 50 to be positioned a significant distance from the cross beam 15 such that it is not accidently contacted by an athlete conducting exercises or drills with the training device 10. In addition, the length of arm assemblies 25, 35 relative to the lateral dimension of body portion 51 of impact member 50 is significant to permit manual adjustment of the distance between the hand grips 28 and 42 and the location of impact member 50 to accommodate athletes having differing size characteristics.

Once installed on the frame 11, the impact member 50 may be readily adjusted and tensioned by the adjustable arm assembly 35. Since arms 25 and 35 are locked in position against the stops 15'' and 15'', as depicted in the solid line position in FIG. 1, any effective shortening of body portion 51 will result in increased tensioning of the impact member 50. To effect this tensioning, the sleeve 37 is moved axially along support 36 from its rotationally locked position until the sleeve 37 moves out of engagement with the flanges 16 and 17 of cross beam 15. The sleeve 37 is then rotated to wrap the loop 53 and an extent of body portion 51 around the sleeve 37. The rectangular cross section of the sleeve 37, the use of a snugly fitting loop 53, and the elastomeric material of impact member 50 combine to provide sufficient frictional adherence between loop 53 and sleeve 37 such that the loop 53 will not rotationally slide on sleeve 37. When a sufficient extent of tension has been imparted to impact member 50, the sleeve 37 is axially moved along support 36 until such time as it returns in the rotationally locked position in engagement with flanges 16 and 17 of sleeve 37. As hereinbefore indicated, the spring 39 assists in effecting return of sleeve 37 and maintains it in the locked position until such time as further tension adjustments might be desired or training device 10 is to be disassembled by removal of the impact member 50.

The training device 10 can be permanently mounted in a horizontal, vertical, or other appropriate position as may be desired for particular training exercises. However, in many instances, it is most desirable that training device 10 be employed in the mobile, portable form as depicted in FIG. 1 of the drawings. This permits use of training device 10, wherein the device is held by one person, and the drills are carried out by an athlete. It is also possible for an athlete to grasp the handles 28 and 42 and conduct drills by way of individual training. It is, however, highly desirable that the U-shaped frame 11 be constructed of relatively heavy material, such as steel, in order to resist displacement of the frame 11 when the impact member 50 is engaged and resiliently displaced by an athlete. Due to the desirability of frame 11 being of significant weight, it may be difficult, in some instances, for athletes to hold the training device 10 by handles 28 and 42 in a horizontal position as for running exercises as depicted in FIG. 6.

Figure 4:
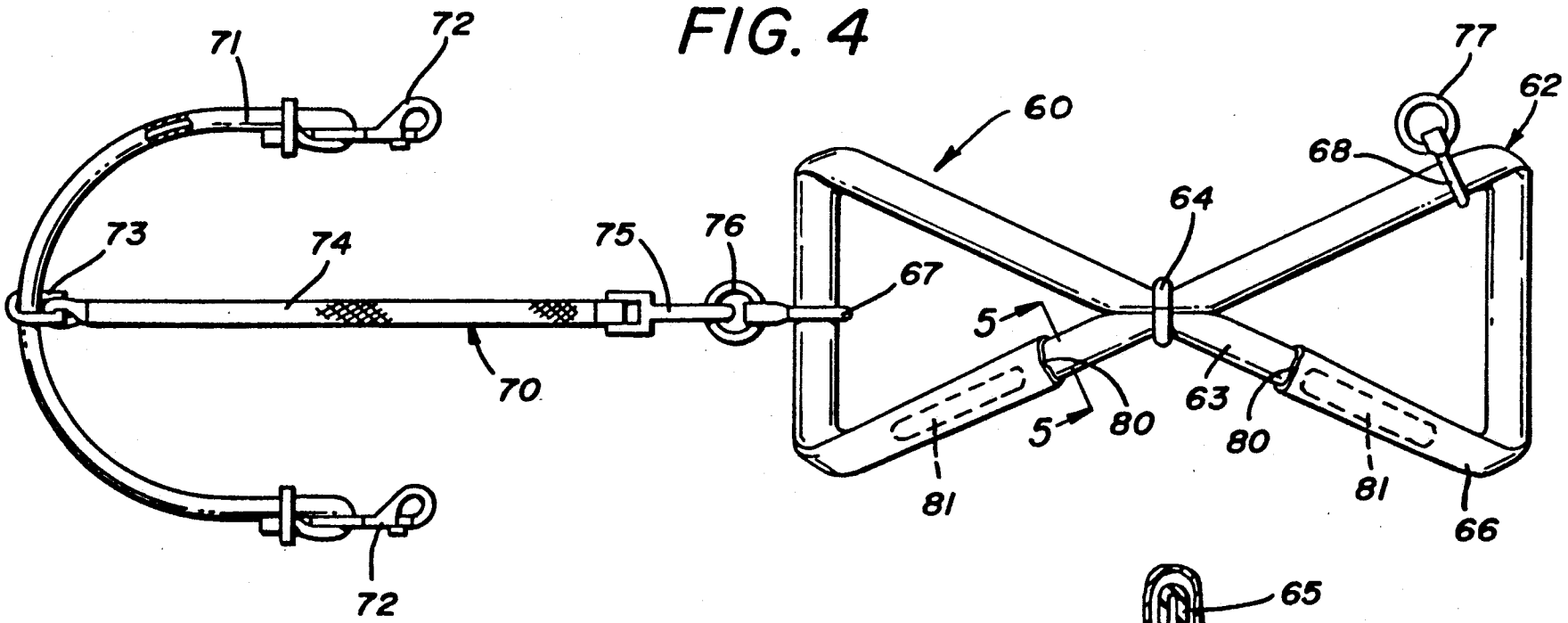
FIG. 4 is a top plan view of a chest vest connector for an athlete's usage in supporting the plyometric training device for individualized training.
Figure 5:
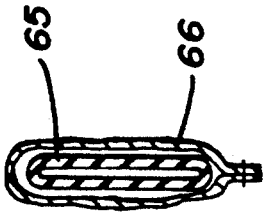
FIG. 5 is an enlarged sectional view taken substantially along the line 5—5 of FIG. 4 showing details of the construction of the chest vest portion of the chest vest connector.

Thus, for individual training by a single athlete, it is advantageous for an athlete A to employ a harness, generally indicated by the numeral 60 in FIG. 6, to assist in supporting and stabilizing training device 10 while drills or exercises are carried out. The harness 60 has as a body engaging portion a vest assembly, generally indicated by the numeral 62. As seen in FIGS. 4–6, inclusive, the vest assembly 62 may be a continuous strip 63, which is generally in the configuration of a FIG. 8 as constituted by an O-ring 64 which is positioned on the back of athlete A. The continuous strip 63, as seen in FIGS. 4 and 5, may advantageously consist of a tubular inner element 65, which may be elastomeric to easily deform to body contours and to provide an extent of give under loading conditions to thus act as a shock absorber. The inner element 65 may be provided with a cover 66, which is of a cloth or other material, for comfortably engaging the upper torso of the athlete A. If desired, an extent of padding (not shown) may be supplied between the tubular inner element 65 and cover 66 or judiciously placed exteriorly of cover 66. The harness 60 has, for purposes of connecting vest assembly 62 with training device 10, a connecting cable assembly, generally indicated by the numeral 70. The cable assembly 70 may take a variety of forms as will be appreciated by persons skilled in the art; however, it may consist of a length of cable 71 having spring loaded snaps 72 at each extremity thereof. The snaps 72 may advantageously be selectively attached to eyes 21 and 31 of bolts 20 and 30 in the manner generally depicted in FIG. 6 of the drawings.

The cable 71 may carry a D-ring 73 permanently attached to an interconnect cable 74. The extremity of interconnect cable 74 opposite D-ring 73 may also mount a conventional snap 75. The snap 75 is adapted for selective attachment to O-rings 76 and 77, one of which is positioned on each of the loops of the strip 63 of vest 62 as by D-rings 67 and 68. With the snap 75 joining both O-rings 76 and 77, the vest assembly is secured about the torso of athlete A, and the interconnect cable 74 emanates from a position proximate the middle of the upper torso of athlete A, as seen in FIG. 6.

If desired, the vest 62 may be provided with pockets 80 for purposes of receiving and retaining one or more weights 81. Normally, only minimal weights, if any, are employed in conjunction with plyometric exercises in view of the importance of speed of execution. However, the vest 62 may, as an ancillary application, be employed in connection with resistance training drills wherein a cable or resilient band could be attached to either the ring 64 or rings 76 and 77 of the vest 62.

It will, thus, be appreciated that an athlete A equipped with training device 10 and the harness 60, as depicted in FIG. 6 of the drawings, can readily maintain the training device 10 in the depicted horizontal position for carrying out plyometric running exercises and drills. It will also be noted that running in place with the training device 10 thus positioned will result in the advantageous decreasing in the time between the eccentric contraction and the concentric contraction of the leg muscles as instituted by the resilient return of the impact member 50 after it has been engaged by the athlete's leg and displaced upwardly. In addition, the athlete A can readily engage in controlled overspeed training in that the involuntary accelerated return of the legs from the upwardly extended position in contact with impact member 50 is positively insured by the powered return of impact member 50.

Thus it should be evident that the plyometric training device disclosed herein carries out the various objects of the invention set forth hereinabove and otherwise constitutes an advantageous contribution to the art. As will be apparent to persons skilled in the art, modifications can be made to the preferred embodiment disclosed herein without departing from the spirit of the invention, the scope of the invention being limited solely by the scope of the attached claims.

I claim:

1. Athletic training apparatus for conducting conditioning drills or exercises comprising, generally U-shaped frame means having cross beam means and a pair of extending arm means spaced and joined by said cross beam means, impact means of elastomeric material suspended between said arm means, and means for selectively adjustably tensioning said impact means, said means for selectively adjustably tensioning said impact means includes sleeve means selectively rotatably mounted on one of said arm means for engaging said impact means.

2. Apparatus according to claim 1, wherein said impact means has loops for effecting attachment to said arm means, said impact means wrapping about said sleeve means upon rotation thereof to selectively tension said impact means.

3. Apparatus according to claim 2, wherein said sleeve means interfits within flange means affixed to said frame means to selectively preclude rotation of said sleeve means relative to said arm means.

4. Apparatus according to claim 3, wherein said sleeve means is mounted for movement axially of said arm means, whereby said sleeve means is movable into and out of engagement with said flange means.

5. Apparatus according to claim 4, wherein said sleeve means is of rectangular cross section and said flange means includes a pair of spaced substantially parallel flanges between which said sleeve means is engaged to preclude rotation thereof.

6. Apparatus according to claim 4, including biasing means urging said sleeve means in a direction moving said sleeve means into engagement with said flange means.

7. Apparatus according to claim 6, wherein said biasing means is a spring telescoped over said arm means and interposed between said sleeve means and fixed stop means on said arm means.

8. Apparatus according to claim 1, wherein said arm means have hand grips to facilitate holding said frame means in operative position.

9. Apparatus according to claim 1, wherein said impact means has a body portion having loops at the longitudinal extremities for encasing said arm means and forming a planar surface being substantially coplanar with the plane formed by said arms.

10. Apparatus according to claim 9, wherein said body portion has a lateral dimension substantially less than the length of said arms, whereby said rectangular member may be selectively positioned longitudinally of said arms.

11. Apparatus according to claim 9, wherein said body portion has a lateral dimension of approximately 8 to 15 inches.

12. Athletic training apparatus for conducting conditioning drills or exercises comprising, generally U-shaped frame means having cross beam means and a pair of extending arm means spaced and joined by said cross beam means, impact means of elastomeric material suspended between said arm means, and means for selectively adjustably tensioning said impact means, said cross beam means having laterally offset flanges at each end thereof in which pivot pins for pivotally mounting said arm means are mounted, whereby said arm means may be pivoted from a stored position substantially paralleling said cross beam means to an operative position substantially perpendicular to said cross beam means.

13. Apparatus according to claim 12, wherein the offset flanges at one end of said cross beam means are of a greater lateral extent than the offset flanges at the other end of said cross beam means, whereby said pivot pins may be laterally displaced a different distance from said cross beam means to thereby permit said arm means to lie in adjacent parallel relation and parallel to said cross beam means in the storage position.

14. Apparatus according to claim 12, wherein said arms engage stop means on said cross beam means for locking in the operative position.

15. Apparatus according to claim 14, wherein said arms pivot through an angle of substantially 270° in moving from the storage position to the operative position.

16. Apparatus according to claim 14, wherein said impact means is selectively mountable on and demountable from said arm means, with said impact means maintaining said arm means in the operative position when mounted thereon.

17. Athletic training apparatus held in operative position by an athlete for conducting conditioning drills or exercises comprising, generally U-shaped frame means having cross beam means and a pair of extending arm means spaced and joined by said cross beam means, impact means of elastomeric material suspended between said air means, and harness means interconnecting said frame means and the athlete for assisting the athlete to hold said frame means in operative position for conducting the conditioning drills or exercises, said harness means including a vest means and connecting cable means attached to proximate the extremities of said cross beam means, whereby said frame means may be readily supported in a horizontal position, with said harness means supplemented by grip means positioned on said arm means for support by the hands of the athlete and said connecting cable means having a first cable interconnecting said extremities of said cross beam means at eye bolts attached thereto and a second cable slidably connected to said first cable at one extremity thereof and attached to said vest means at the other extremity thereof.

18. Apparatus according to claim 17, wherein said vest means is a continuous strip for engaging the upper torso of the athlete.

19. Apparatus according to claim 17, wherein said vest means has an inner elastomeric tube and an exterior cover therefor.

* * * * *

UNITED STATES PATENT AND TRADEMARK OFFICE

CERTIFICATE OF CORRECTION

PATENT NO. : 5,199,936

DATED : 4/6/93

INVENTOR(S) : Charles W. Moye

It is certified that error appears in the above-identified patent and that said Letters Patent is hereby corrected as shown below:

Cover page, [56], "2,526,347" should read --2,529,347--.

Column 7, line 50, "FIG. 8" should read --figure 8--.

Column 10, line 29, "air" should read --arm--.

Column 10, line 34, "attached to proximate" should read --attached proximate--.

Signed and Sealed this

Nineteenth Day of July, 1994

Bruce Lehman

*Attest:*

BRUCE LEHMAN

*Attesting Officer*

*Commissioner of Patents and Trademarks*